United States Patent [19]

Laviano

[11] Patent Number: 4,461,164

[45] Date of Patent: Jul. 24, 1984

[54] PRESS CONSTRUCTION

[76] Inventor: Samuel Laviano, 85 S. Poplar St., Gibbstown, N.J. 08027

[21] Appl. No.: 416,120

[22] Filed: Sep. 9, 1982

[51] Int. Cl.[3] ..... B21D 37/12

[52] U.S. Cl. ..... 72/455; 425/406; 425/394

[58] Field of Search ..... 72/455, 456, 404, 442, 72/453.01, 453.18, 273; 100/208, 214, 295; 92/169; 425/406, 408, 411, 415, 416, 394

[56] References Cited

U.S. PATENT DOCUMENTS

| | | | |
|---|---|---|---|
| 2,235,070 | 3/1941 | Giern et al. | 92/169 |
| 3,224,042 | 12/1965 | Meissner | 92/169 |
| 3,863,488 | 2/1975 | Deordiev et al. | 72/453.18 |
| 4,030,389 | 6/1977 | Ponomarenko et al. | 100/208 |

FOREIGN PATENT DOCUMENTS

| | | | |
|---|---|---|---|
| 961410 | 4/1957 | Fed. Rep. of Germany | 72/453.01 |
| 148499 | 11/1981 | Japan | 100/214 |

*Primary Examiner*—Francis S. Husar
*Assistant Examiner*—Linda McLaughlin
*Attorney, Agent, or Firm*—Robert K. Youtie

[57] ABSTRACT

There is disclosed herein a press preferably fabricated of a plurality of plates secured in facing engagement and configured to define a frame having an opening therein, an expansile and contractile ram in the frame opening having its opposite ends respectively movable toward and away from opposite frame ends for performing work between each ram end and the respective adjacent frame end, and a fluid operating system for expanding and contracting the ram in the frame opening.

5 Claims, 6 Drawing Figures

FIG. 1
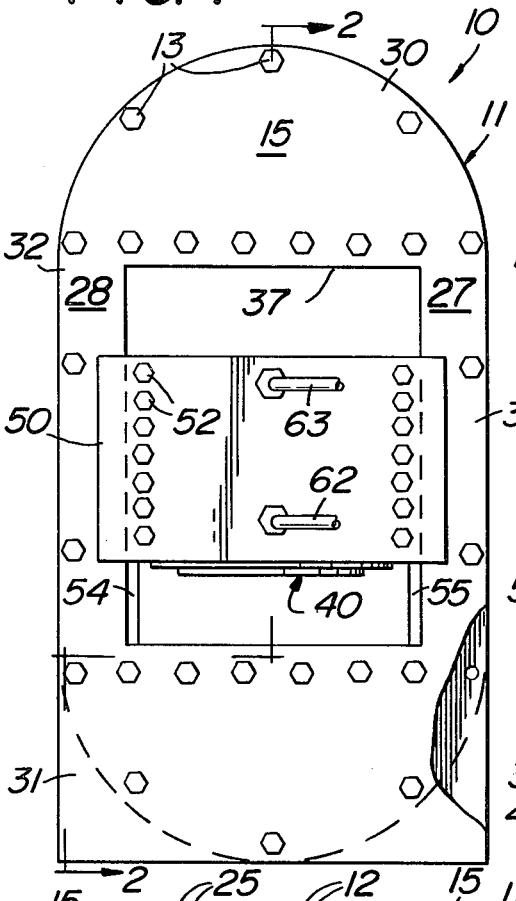
FIG. 2
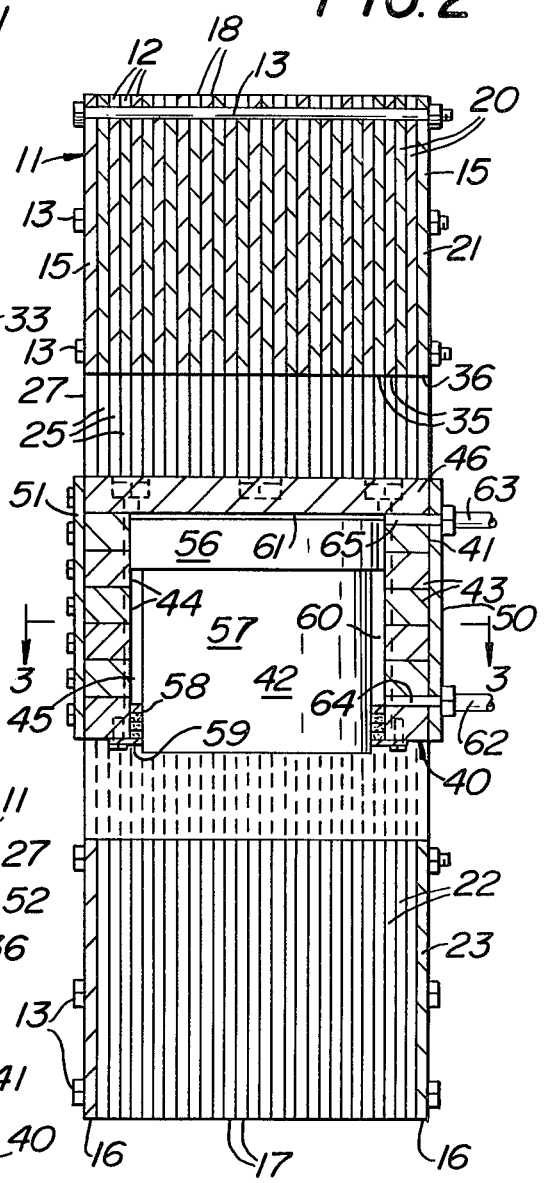
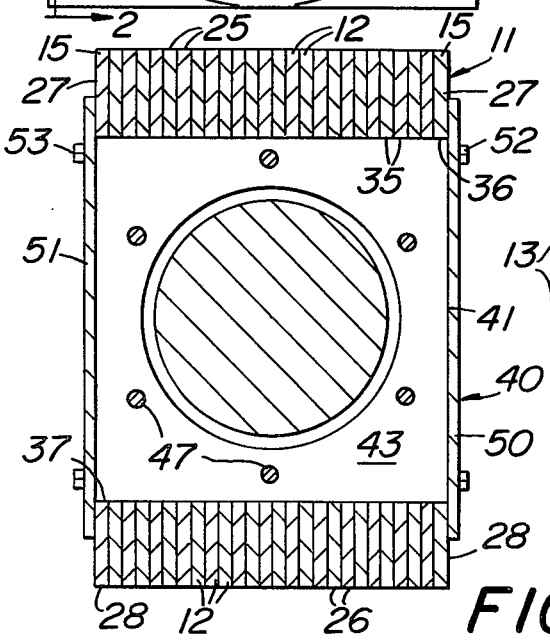
FIG. 3

FIG. 5
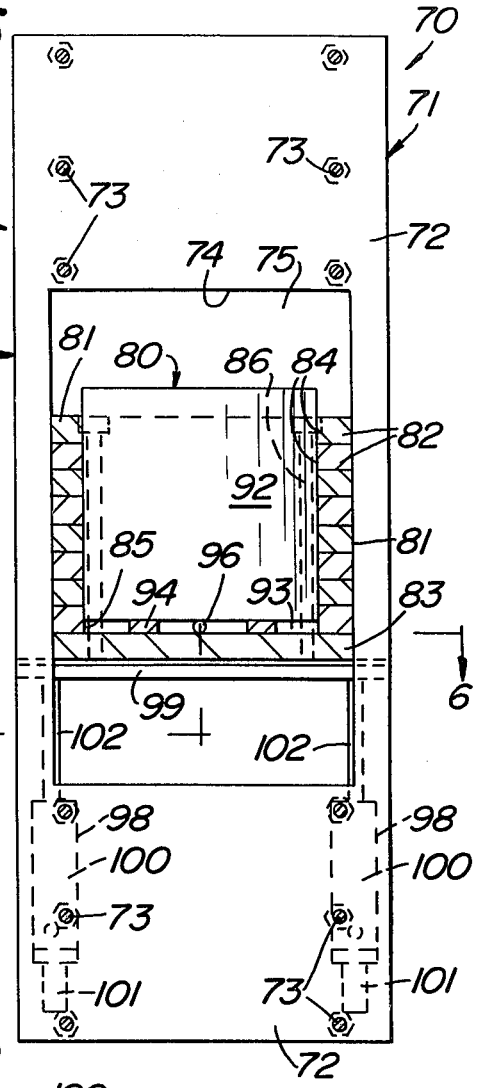
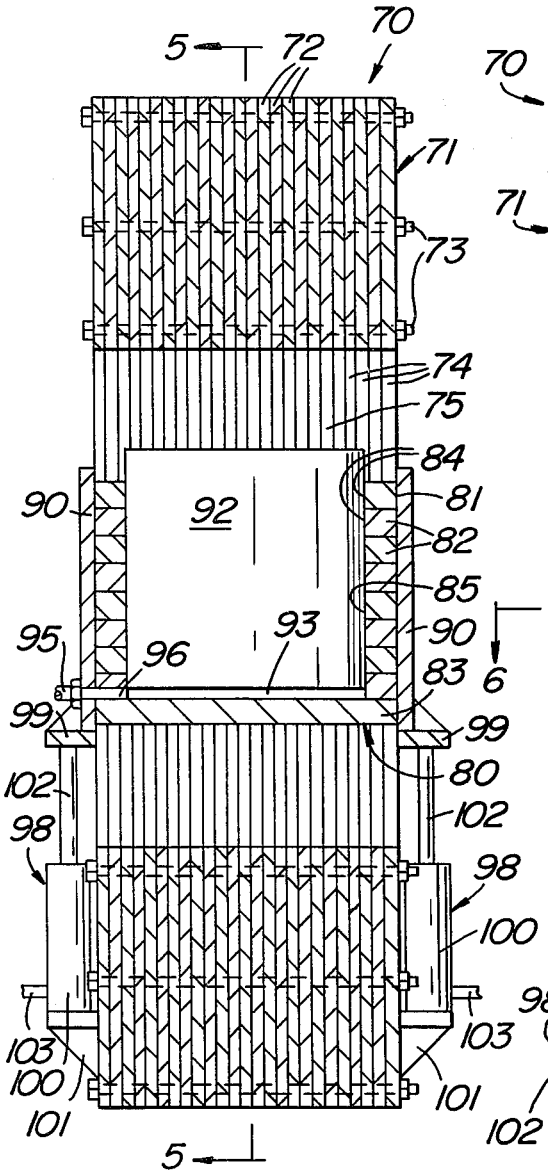
FIG. 4
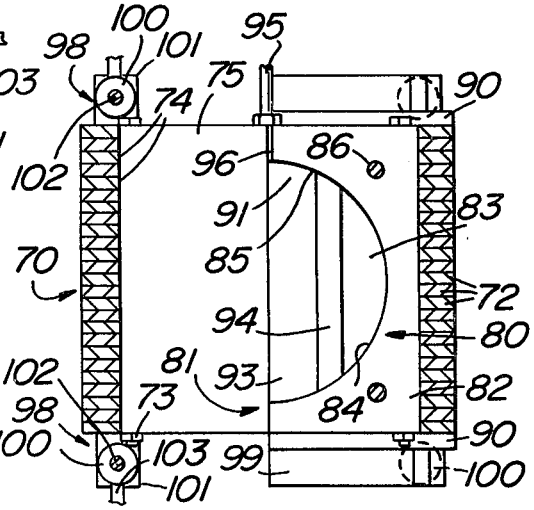
FIG. 6

PRESS CONSTRUCTION

BACKGROUND OF THE INVENTION

This invention is concerned with press construction for use in forging, molding, extrusion, shaping and otherwise forming of metals, plastic, rubber and other materials. As is well known, press construction in larger sizes involves extremely large components, generally made by casting, which is expensive to manufacture, machine and handle. Also, large presses are generally relatively slow acting, so that production is limited and therefore expensive.

SUMMARY OF THE INVENTION

It is, therefore, an important object of the present invention to provide a unique and improved press construction wherein even large presses are fabricated from relatively simple, small and easily handled component parts to achieve extremely high strength and durability at substantial savings in manufacturing costs.

It is another important object of the present invention to provide a press construction which is highly variable in stroke to accomodate work of wide size range; and wherein a ram construction is provided having at its opposite ends a pair of different work receiving spaces for effectively doubling press production with little or no increase in cost or consumption of time.

More specifically, the present invention provides an expansile and contractile ram construction for location in a working opening of a frame to perform work between each end of the ram and the adjacent end of the frame upon ram expansion.

It is another object of the present invention to provide a press construction of the type descirbed in the preceding paragraph wherein the ram may be mounted in the frame opening by slidable retaining plates exteriorly of the frame opening, and quickly and easily removable and replacable by removal and replacement of a retaining plate.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

FIG. 1 is an elevational view showing a press constructed in accordance with the teachings of the instant invention.

FIG. 2 is a sectional view taken generally along the line 2—2 of FIG. 1, slightly enlarged.

FIG. 3 is a transverse sectional view taken generally along the line 3—3 of FIG. 2.

FIG. 4 is a sectional elevational view similar to FIG. 2, but showing a slightly modified embodiment of the present invention.

FIG. 5 is a sectional elevational view taken generally along the line 5—5 of FIG. 4.

FIG. 6 is a transverse sectional view taken generally along the line 6—6 of FIG. 5.

DESCRIPTION OF THE PREFERRED EMBODIMENTS

Referring now more particularly to the drawings, and specifically to FIGS. 1–3 thereof, a press construction is there generally designated 10, and includes a frame 11 which may advantageously be of a laminated type construction, say fabricated of a plurality of plates in facing engagement with each other.

For example, as best seen in FIGS. 2 and 3 a plurality of generally flat plates 12 may be fixedly secured in facing engagement with each other by any suitable means, such as welding, or by bolts 13, or other suitable fastening means.

In the illustrated embodiment the plates 12 may all be substantially identical and congruent in their facing relation. In addition to the plurality of plates 12, there are disposed in facing engagement with opposite sides of the group of plates 12 a pair of outer or face plates 15. The outer or face plates 15 suitably secured, as by the bolts 13, in facing engagement with opposite sides of the bundle of inner plates 12, may be essentially identical to the inner plates, except that their lower edges may be square or straight, as at 16 for stable resting engagement with a suitable supporting surface, while the inner plates 12 may have nonstraight lower edges 17, say semicircular, which may be identical to their upper edges 18, for symmetry of design and economy in manufacture and assembly.

The plates 12 and 15 may all have upper end portions 20 and 21 in congruent facing engagement with each other and spaced over lower end portions 22 and 23 of respective inner and outer plates 12 and 15, also in facing engagement with each other. In addition, the inner plates 12 each include a pair of spaced side portions 25 and 26 extending in parallelism with each other between the upper and lower plate portions 20 and 22. Also, each outer plate 15 includes a pair of spaced generally vertical side portions 27 and 28 extending between the lower and upper outer plate portions 21 and 23. The inner plate side portions 25 and outer plate side portions 27 may be in laminated, congruent facing engagement with each other; and similarly the plate side portions 26 and 28 of inner plates 12 and outer plates 15 may be laminated in facing engagement with each other.

The upper congruent plate portions 20 and 21 may combine to define an upper end 30 of frame 11; while the lower, facing, engaging plate portions 22 and 23 define a lower frame end 31 spaced below upper frame 30; and one laminated group of side plate portions 25, 27 defines a frame side 32; while the other group of laminated side portions 26 and 28 defines a frame side 33 parallel to and spaced from the frame side 32.

As will now be appreciated, each plate 12, 15 is formed with a central through opening, as at 35 and 36, respectively, which openings are generally rectangular and in congruent, aligned relation with each other, combining to define a working opening 37 for performance of work in the press 11.

It will be appreciated that the press, as described hereinbefore, may be economically fabricated by merely cutting the plates 12 and 15 and securing the plates in their facing engagement, without the need for pouring, machining and handling of large castings, or other expensive procedures.

Located in the working opening 37, for operation therein is a ram, generally designated 40. The ram 40 is constituted essentially of a piston-in-cylinder construction, specifically including a cylinder 41 and piston 42. The cylinder 41 is vertically shiftable in the frame opening 37, and in the illustrated embodiment has its upper end closed and lower end open. More specifically, the cylinder 41 may be fabricated of a plurality of plates 43 secured in laminated, facing engagement with each other, and all provided with central openings 44 in registry with each other and combining to define the hollow interior of the cylinder 41. The cylinder 41 is advantageously fabricated of the multiple plates 43, as best seen in FIGS. 2 and 3, say by cutting central holes to form the hollow interior 45. The material removed from the plates 43 may advantageously be stacked, suitably secured and machined to form the received piston or piston body 57, as will appear more fully hereinafter.

A best seen in FIG. 2, the plurality of centrally open cylinder plates 43 are disposed generally horizontally and in a congruently stacked or superposed relation with each other to define the hollow interior 45 of the cylinder 41. Superposed on the stacked plates 43 is an upper, closure plate 46 extending across and closing the upper end of the hollow cylinder 45. The superposed or stacked plates 43 and 46 may be suitably secured together by any desired means, such as tie members or bolts 47.

In horizontal plan view, the cylinder 41 may substantially completely fill the working opening 37, as best seen in FIG. 3, while being spaced between the upper and lower frame ends 30 and 31, as seen in FIGS. 1 and 2.

A pair of guide members or plates 50 and 51 may be secured to opposite sides of the cylinder 41, as by fastener means 52 and 53, the plates being generally vertically disposed in facing, sliding engagement with the outer surfaces of frame sides 27 and 28. Thus, the guide members or plates 50 and 51 retain the cylinder 41 in the frame opening 37, being slidable relative to the frame to constrain the cylinder to vertical, up and down movement in the frame opening. Suitable supports or shoulder pieces 54 and 55 may upstand from the bottom wall of frame opening 37, respectively adjacent to frame sides 27 and 28 for supporting the cylinder 41 at a selected elevation in the frame opening. The supports 54 and 55 are suitably narrow so as not to obstruct the interior cylinder opening 45.

The cylinder interior or hollow 45 slidably receives the piston 42, which may include an enlarged upper end or head 56 slidable in and in suitably sealed relation within the cylinder cavity 45 toward and away from the closed cylinder end plate 46. Depending from the enlarged piston head 56 is the piston body 57 of reduced diameter relative to the head, so as to be concentrically within and spaced from the internal wall or surface of the cylinder hollow 45. Extending about the lower end of the cylinder interior 45 is gasketing, sealing or closure means, such a sealing rings 58 retained by a retainer ring 59 secured to the lower end of the cylinder 41. Thus, the sealing means 58 and enlarged piston head 56 close opposite lower and upper ends of the annular space 60 between the body 57 of piston 42 and the interior surface of the cylinder opening 45. An additional, separate space or chamber 61 is formed in the interior of the cylinder 41, between the upper enlarged piston end or head 56 and the closed upper cylinder end or wall 46. Fluid connection means, such as conduits 62 and 63 may be carried by guide plate 50 and communicate respectively, through passageways 64 and 65 with chambers 60 and 61. Of course, a suitable source of pressurized fluid and control valving, all of which may be conventional, are associated with the fluid conduit means 62 and 63 for selectively introducing fluid under pressure into the chambers 60 and 61.

In the illustrated condition of FIG. 2 the ram piston 42 is retracted into the cylinder 41, as resulting from fluid under pressure being introduced into chamber 60 to expand the latter, while permitting the egress of fluid under pressure from chamber 61. Extension of piston 42 from cylinder 41 is effected by introducing pressurized fluid through conduit 63 and passageway 65 into expansile chamber 61. Initially, the ram piston 42 will extend downwardly into engagement with work in the frame opening 37 below the ram 40. Upon such lower work engagement by piston 42, continued pressure in chamber 61 effects upward movement of the cylinder 41 into engagement with additional upper work in an upper region of the frame opening 37 between the upper cylinder wall 46 and upper frame end 30. Further pressure in chamber 61 accomplishes both the lower and upper work, so that the ram 40 is double acting, and cooperates with the frame 11 to effect work in the frame opening 37 both below and above the ram.

The limiting downward position of the cylinder 41 may be changed, as desired, by selectively replacing the support members 54 and 55 with other, like support members of different vertical extent.

After completion of the work at both ends of the frame opening 37, pressure may be released in chamber 61 through conduit 63, and fluid pressure applied to chamber 60 through conduit 62 and passageway 64. This application of or increase in fluid pressure to the auxiliary chamber 60 effects retraction of the piston 42 into the cylinder 41, enabling removal of finished work and replacement by unfinished work.

Referring now to FIGS. 4–6, a slightly modified embodiment of the present invention is illustrated therein, including a press generally designated 70 including a frame 71 which may be generally similar to the frame 11, advantageously fabricated by the lamination of plural layers of plates 72 suitably secured together in facing engagement with each other by any desired means, such as fasteners or bolts 73. The several plates 72 may be substantially congruent, each having a central through hole, as at 74, all of which are aligned with each other to define a working opening 75 in the press frame 71.

Slidable vertically in the working opening 75 is an expansile and contractile ram 80, including a cylinder 81 which may substantially completely occupy the working frame opening 75, in the horizontal plan view as seen in FIG. 6, and which is spaced vertically from the upper and lower ends of the working opening 75, as seen in FIGS. 4 and 5. The cylinder 81 may be fabricated in laminar fashion of a plurality of horizontal, stacked plates 82 superposed on each other, and a lowermost plate 83 in facing engagement with the lowermost of the plates 82. The several plates 82 may each have a central through hole or opening 84, which holes are aligned in registry with each other to define the interior surface 85 of the cylindrical hollow of cylinder 81. The lowermost plate 83 is absent the central hole and extends in closing relation across the lower end of the cylinder 81; the plurality of plates 82 and 83 being suitably secured together in their laminated relation, as by fasteners 86, or other suitable means.

Secured to opposite sides of the cylinder 81, exteriorly of the frame opening 75 and overlapping the frame sides or uprights bounding the opening 75 are a pair of generally vertically disposed, guide members or plates 90. The plates 90 constrain the cylinder 81 to up and down movement in the working opening 75.

The interior of the cylinder, slide or crosshead 81 of the ram 80 is provided with a generally cylindrical cavity or hollow 91, being closed on its underside by the lowermost plate 83 and opening upwardly. A piston 92 is conformably and slidably received in the cavity 91, and combines with the cylinder 81 to define therebetween a chamber 93 expansile and contractile upon relative movement of the piston in the cylinder. Any suitable fluid sealing may be employed between the piston 92 and internal surface 85 of the cavity 91 to seal the expansile chamber 93.

Limit means or stops, such as bars 94 may be provided in the lower end of the chamber 93 to limit retractile movement of the piston 92 in the cylinder 81. Also, fluid connection means, as at 95, may constitute a conduit connected at one end to a source of fluid under pressure, and communicating such source through a passageway 96 in the cylinder 81 to the chamber 93. Conventional controls may be associated with the conduit 95 for controlling pressure fluid communication with the chamber 93.

In addition, a pair of piston-in-cylinder assemblies 98 may be suitably connected between each guide member or plate 90 and the frame 71. In particular, each guide plate 90 may be provided along its lower edge with an outstanding flange 99, generally horizontally coextensive with the associated guide plate. At laterally spaced locations, a cylinder 100 of each assembly 98 may be suitably secured, as by a bracket 101 to a lower region of the press frame 71; and, a piston rod 102 upstanding from each assembly 98 remote from the bracket 101 may be suitably secured to the flange 99. Each piston-in-cylinder assembly 98 is suitably connected, as by conduit means 103, through conventional controls (not shown) to a source of fluid under pressure.

It will now be apparent that, upon release of pressure in the several assemblies 98, and exertion of pressure through conduit 95 to the chamber 93, the ram 80 will be caused to expand, the piston 92 moving upwardly against gravity and the cylinder 81 moving downwardly against any residual force exerted by the assemblies 98, to effect a work operation in the opening 75, both above the ram 80 and below the ram 80. At the end of this double acting press operaton, the expansile chamber 93 may be relieved or vented, and fluid pressure exerted in the several expansile chambers of cylinders 100. This will permit gravitational downward return movement of the piston 92 in the cylinder 81, and upward return of the cylinder 81 to a level predetermined by suitable stop means for repetition of the press operation.

It will now be appreciated that, by the hereinbefore described double acting operation, the press of the present invention is capable of delivering equal tonnage at both ends of the press, on opposite sides of the ram assembly, so as to effectively double productivity of a conventional press of like size. Thus, the present invention provides a press construction of greatly increased production, adapted for manufacture and assembly at reasonable cost, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A press construction comprising opposite frame ends, frame sides connected between said frame ends, said frame ends and sides combining to define a frame having therein a working opening, expansile and contractile ram means mounted in said opening having its opposite ends adjacent to respective opposite frame ends, and fluid operating means for expanding and contracting said ram means respectively toward and away from said frame ends for performing work between each end of said ram means and the adjacent frame end, said ram means comprising a hollow cylinder having one end open and one end closed, a piston slidable in the hollow of said cylinder and having one end extending outwardly through the open end of said cylinder, said closed cylinder end and said extending piston end constituting said opposite ram ends, the interior of said cylinder between said closed cylinder end and piston defining an expansile and retractile fluid chamber for expanding and contracting said ram means, and guide members secured exteriorly of said cylinder and extending exteriorly of said frame to mount said ram means for longitudinal movement relative to said frame.

2. A press construction according to claim 1, said fluid operating means comprising conduit means communicating with said chamber for effecting relative shifting movement of said piston and cylinder.

3. A press construction according to claim 1, in combination with an auxiliary expansile chamber associated with said ram means for contracting the latter, auxiliary fluid operating means connected to said auxiliary expansion chamber for expanding the latter to contract said ram means and release pressure in said auxiliary expansion chamber for expanding said ram means, an enlarged head on the inner end of said piston adjacent to said closed cylinder end and combining with the latter to define said first mentioned expansile chamber, said piston remote from said first mentioned expansile chamber being spaced from said cylinder to define said auxiliary expansile chamber, and closure means carried by said cylinder adjacent to said open cylinder end engaging said piston to close said auxiliary expansile chamber.

4. A press construction according to claim 1, said frame consisting essentially of a plurality of frame plates all in facing engagement with each other and all having aligned cut-outs defining said working opening.

5. A press construction according to claim 4, said ram means comprising a plurality of cylinder plates in facing engagement with each other normal to the direction of ram movement and all except at least one end cylinder plate having aligned cut-outs to define a cylinder.

* * * * *